US011598134B2

(12) United States Patent
Seppänen et al.

(10) Patent No.: US 11,598,134 B2
(45) **Date of Patent: *Mar. 7, 2023**

(54) DOOR CLOSER ARRANGEMENT

(71) Applicant: Abloy Oy, Joensuu (FI)

(72) Inventors: Sauli Seppänen, Joensuu (FI); Juhani Karvonen, Kuopio (FI)

(73) Assignee: ABLOY OY, Joensuu (FI)

( * ) Notice: Subject to any disclaimer, the term of this patent is extended or adjusted under 35 U.S.C. 154(b) by 155 days.

This patent is subject to a terminal disclaimer.

(21) Appl. No.: 17/144,719

(22) Filed: Jan. 8, 2021

(65) Prior Publication Data

US 2021/0214981 A1 Jul. 15, 2021

(30) Foreign Application Priority Data

Jan. 9, 2020 (EP) ..... 20150903

(51) Int. Cl.
*E05F 1/10* (2006.01)
*E05F 3/22* (2006.01)

(52) U.S. Cl.
CPC ..... *E05F 1/10* (2013.01); *E05Y 2201/482* (2013.01); *E05Y 2201/624* (2013.01); *E05Y 2201/64* (2013.01); *E05Y 2201/652* (2013.01); *E05Y 2201/656* (2013.01); *E05Y 2201/684* (2013.01); *E05Y 2201/692* (2013.01); *E05Y 2600/45* (2013.01); *E05Y 2600/46* (2013.01); *E05Y 2900/132* (2013.01)

(58) Field of Classification Search
CPC ..... E05C 17/02; E05C 17/54; E05C 17/34; E05C 17/32; E05F 3/22; E05F 3/221; E05F 3/227; E05F 1/08; E05F 1/10; E05F 2003/228; E05F 2201/412; E05F 2201/414; E05F 2201/482; E05F 2201/64; E05F 2201/652; E05F 2201/656; E05F 2201/684; E05Y 2900/132; Y10T 16/469; Y10T 16/459; Y10T 16/462; Y10T 16/593; Y10T 16/56; Y10T 16/585; Y10T 16/27; Y10T 16/281
See application file for complete search history.

(56) References Cited

U.S. PATENT DOCUMENTS 3,909,877 A * 10/1975 Christy ..... E05F 3/221 16/85
4,419,787 A * 12/1983 Lieberman ..... E05F 1/1008 16/65
4,506,407 A * 3/1985 Downey ..... E05F 3/222 16/320
4,759,099 A * 7/1988 Morano ..... E05F 3/102 16/64

(Continued)

FOREIGN PATENT DOCUMENTS

EP 2 236 717 A2 10/2010

*Primary Examiner* — Chuck Y Mah
(74) *Attorney, Agent, or Firm* — Muncy, Geissler, Olds & Lowe, P.C.

(57) ABSTRACT

The aim of the invention is to achieve a door closer arrangement (1) where the force needed for opening the door (2) is not so substantial. The invention comprises a door closer (6), a slide rail (7), and an arm (8) that connects the door closer with the slide rail. The arrangement comprises also a second rail (9), which is arranged to form a slide slope for the door closer (6) and the auxiliary spring arrangement.

22 Claims, 7 Drawing Sheets

(56) References Cited

U.S. PATENT DOCUMENTS

| | | | | |
|---|---|---|---|---|
| 5,448,798 | A * | 9/1995 | Coleman | E05C 17/28 16/85 |
| 5,636,476 | A * | 6/1997 | Eikmeier | E05F 11/16 49/246 |
| 6,138,412 | A * | 10/2000 | Rieckmann | E05F 15/53 49/340 |
| 6,253,417 | B1 * | 7/2001 | Rusiana | E05C 17/28 16/65 |
| 9,238,399 | B2 | 1/2016 | Okuma et al. | |
| 2001/0007163 | A1 * | 7/2001 | Alonso | E05F 3/221 16/58 |
| 2010/0223754 | A1 | 9/2010 | Tomioka et al. | |
| 2015/0211278 | A1 * | 7/2015 | Moyer | E05F 3/102 16/52 |
| 2016/0362924 | A1 * | 12/2016 | Fan | E05F 5/08 |
| 2017/0081892 | A1 * | 3/2017 | Fan | E05F 1/105 |
| 2018/0002965 | A1 | 1/2018 | Sauter et al. | |
| 2019/0093407 | A1 * | 3/2019 | Lygin | E05F 15/63 |
| 2020/0340280 | A1 * | 10/2020 | Oakley | E05F 3/227 |
| 2021/0071458 | A1 * | 3/2021 | Eickhoff | E05F 3/227 |

* cited by examiner

DOOR CLOSER ARRANGEMENT

FIELD OF TECHNOLOGY

The invention relates to door closer arrangements, which are used when doors are closed and opened.

PRIOR ART

Door closers are used in order to close doors after the opening operations of the doors. The door closer can be mounted on the surface of a door or on the surface of a door frame. Some door closer arrangements comprise a slide rail. If the door closer has been mounted on the door, the slide rail has been mounted on the door frame, or the installation is vice versa.

When the door is opened the opening force is quite big at the small opening angles of the door. This is due to the structure of the door closer having a spring inside. The spring tensions when the door is opened. The tension of spring moves the piston of the door closer back to its initial position, i.e. moves the door to the closed position, after the opening of the door. So, the user of the door does not need to push or pull the door for closing it.

The user of the door can notice that the force needed to open the door is substantial at the beginning of the opening operation. The force needed may be experienced to be too big and therefore unpleasant. On the other hand, it may occur that when closing the door, the closing power may be not enough to close the door properly in all situations.

SHORT DESCRIPTION

The object of the invention is to achieve a door closer arrangement where the force needed for opening the door is not so substantial than in known solutions, and the closing power is improved. The aim of the invention is obtained by a door closer arrangement of an independent claim. Dependent claims illustrate different embodiments of the invention.

A door closer arrangement according to the invention comprises a door closer, a slide rail, and an arm that connects the door closer with the slide rail. The arrangement comprises also a second rail, and a carriage to be attached to the second rail in a sliding manner. The carriage is arranged to form an attachment with the door closer. The door closer arrangement further comprises a first low-friction arrangement between the second rail and the carriage, and a second low-friction arrangement between the arm and the slide rail. The door closer arrangement also comprises an auxiliary motion arrangement in order to aid movement of the carriage and the door closer along the second rail. The auxiliary motion arrangement comprises a raising part at a first end of the second rail forming a slide slope for the door closer. The first end is the end to be installed nearby a hinge side of a door. The auxiliary motion arrangement comprises also an auxiliary spring arrangement.

LIST OF FIGURES

In the following, the invention is described in more detail by reference to the enclosed drawings, where FIG. 1 illustrates an example of a door closer arrangement according to the invention when a door is closed, FIG. 2 illustrates the door closer arrangement according to the invention from the bottom view when the door is closed, FIG. 3 illustrates the door closer arrangement according to the invention from the top view when the door is closed, FIG. 4 illustrates the door closer arrangement according to the invention when the door opened about 15-20 degrees, FIG. 5 illustrates a back view of the door closer arrangement according to the invention in the position of FIG. 4, FIG. 6 illustrates the door closer arrangement according to the invention when the door is opened about 50-60 degrees, FIG. 7 illustrates a back view of the door closer arrangement according to the invention at the position of FIG. 6, FIG. 8 illustrates the door closer arrangement according to the invention in the position about 20-30 degrees when closing the door, FIG. 9 illustrates a back view of the door closer arrangement according to the invention at the position of FIG. 8, FIG. 10 illustrates the door closer arrangement according to the invention in the closed position, FIG. 11 illustrates embodiments of parts belonging to an arrangement according to the invention, FIG. 12 illustrates a detailed view of FIG. 11, showing bearing arrangements of the inventive embodiment FIG. 13 illustrates other embodiments of the bearing arrangement, FIG. 14 illustrates a top view of the door closer arrangement according to the invention when the door is fully opened, FIG. 15 illustrates an example of the second low-friction arrangement comprising a second bearing arrangement.

DESCRIPTION OF THE INVENTION

Figure 1:
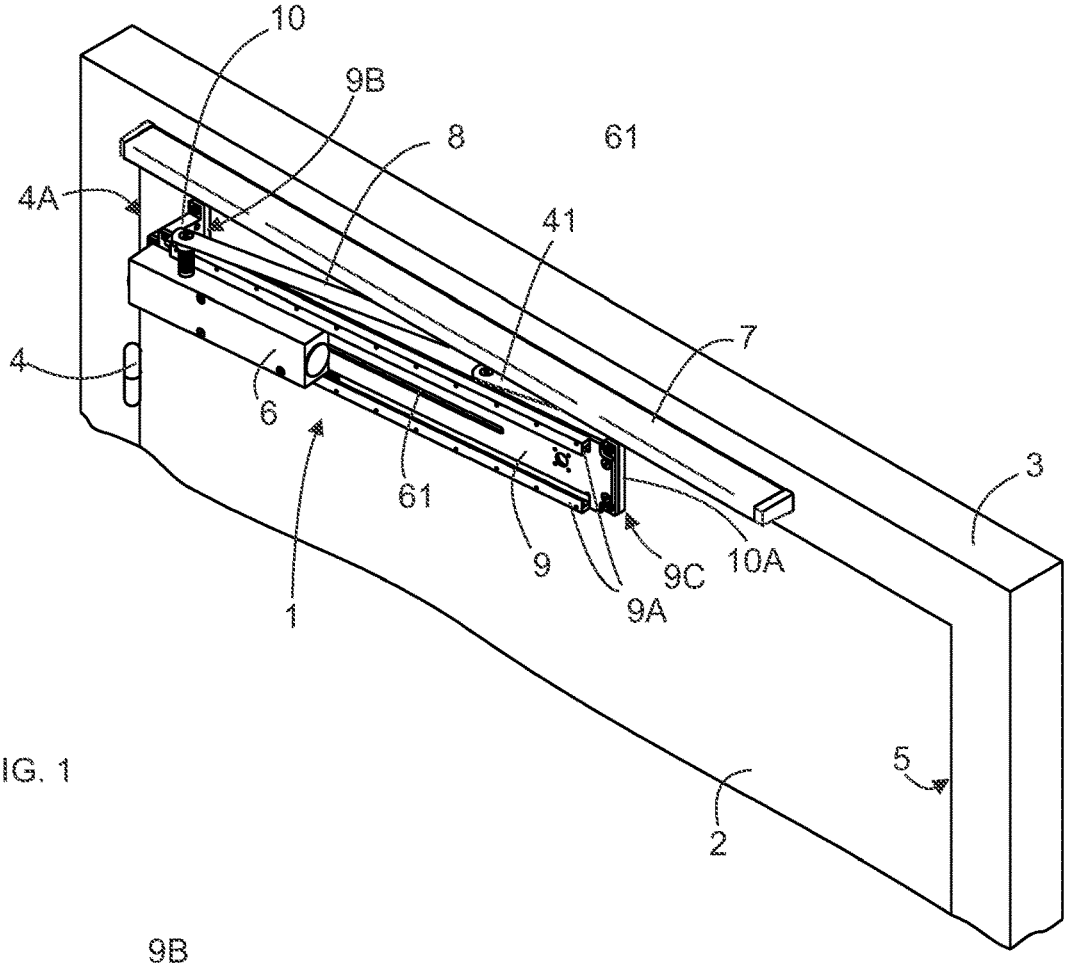

FIG. 1 illustrates an example of a door closer arrangement 1 according to the invention when a door 2 is closed. The door closer arrangement 1 comprises a door closer 6, a slide rail 7, and an arm 8 that connects the door closer 6 with the slide rail 7. The arrangement comprises also a second rail 9, and a carriage 17 to be attached to the second rail 9 in a sliding manner. See FIG. 11. The carriage 17 is arranged to form an attachment with the door closer 6. The door closer arrangement also comprises a first low-friction arrangement 18 between the second rail 9 and the carriage 17, and a second low-friction arrangement 16 between the arm 8 and the slide rail 7. See FIG. 11. The door closer arrangement also comprises an auxiliary motion arrangement 10 in order to aid movement of the carriage 17 and the door closer 6 along the second rail 9.

The auxiliary motion arrangement comprises a raising part 10 at a first end 9B of the second rail forming a slide slope for the door closer. The first end is the end to be installed nearby a hinge side 4A of a door 2. The auxiliary motion arrangement comprises also an auxiliary spring arrangement 67. See FIG. 5.

Figure 2:
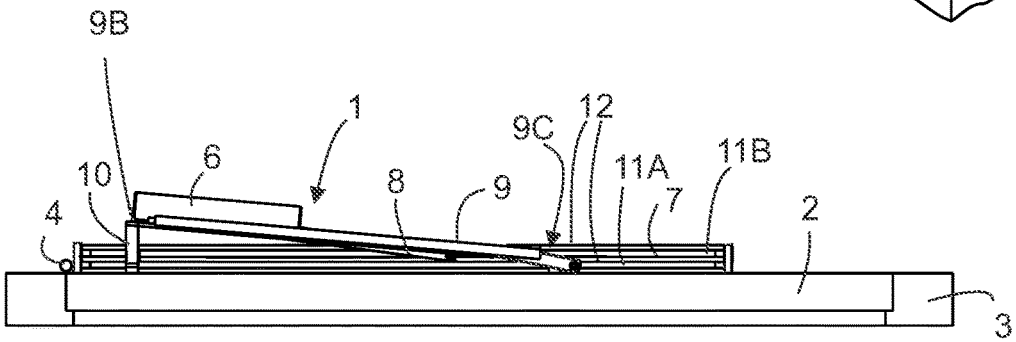
Figure 3:
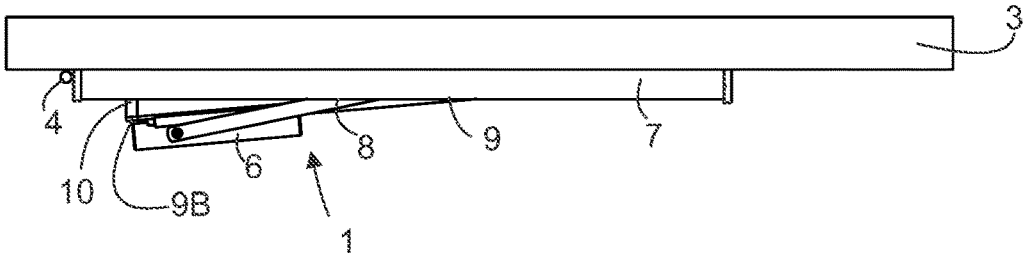

As can be seen in FIG. 1, the door 2 is installed on the frame 3 of the door utilizing hinges 4. So, the side of the door towards the hinges 4 is a hinge side 4A, and the other side is a lock side 5 wherein a possible door lock is installed. FIGS. 2 and 3 show the bottom view and the top view when the door 2 is closed. FIG. 2 shows slots 11A and 11B and projections 12 of the slide rail 7, which are used for the attachment with the second low-friction arrangement 16.

The second rail 9 makes it possible that the door closer can move along the second rail. The movement of the door closer when opening and closing the door 2 makes the opening of the door more easy and also improves the closing of the door. FIGS. 4-10 and FIG. 14 illustrate movement of the door closer 2 at different angles of the door.

The auxiliary spring arrangement 67 is showed in more detail in FIGS. 5, 7, 9 and 10. The auxiliary spring arrangement 67 comprises a harvesting arm 41, a carrier 43 and a third rail 45. The third rail is on the second rail 9 and the carrier is attached moveable on the third rail 45 so that the carrier 43 is capable to move along the third rail. When the door 2 is turned opened, the harvesting arm 41 moves along the slide rail 7 and also with the carrier 43 along the third rail. So, when the opening angle of the door increases, the carrier 43 moves towards the hinge side 4A of the door. The harvesting arm 41 is turnable attached to the carrier at a first end 41B of the harvesting arm 41, and turnable and moveable attached to the slide rail 7 at a second end 41A of the harvesting arm. The attachment at the second end 41A of the harvesting arm can be obtained similarly as the attachment of the arm 8 with the slide rail 7. The attachment at the first end 41B of the harvesting arm can utilize a swivel axis.

Figure 4:
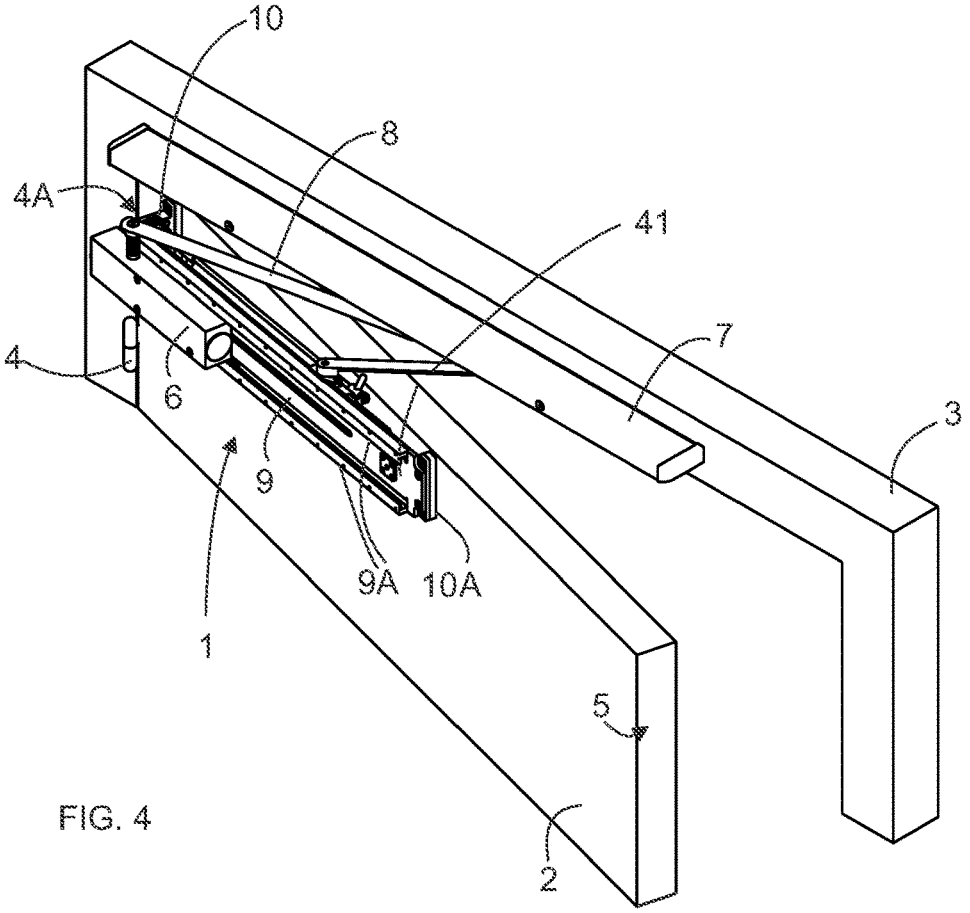
Figure 5:
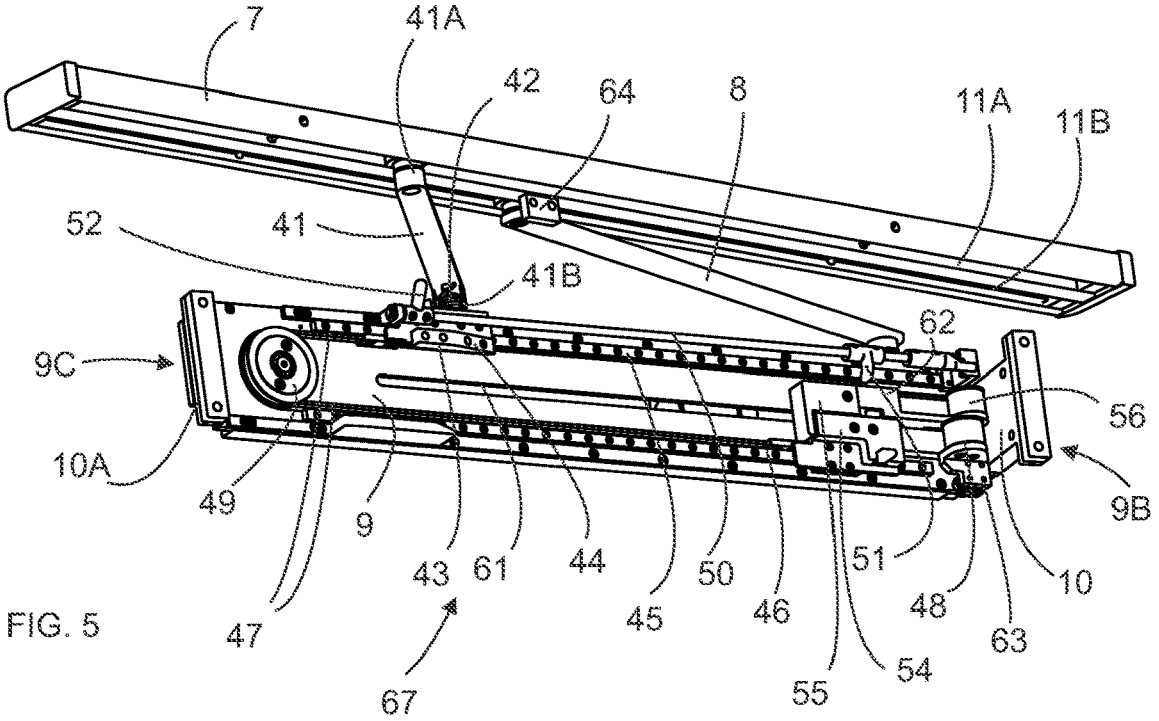
Figure 6:
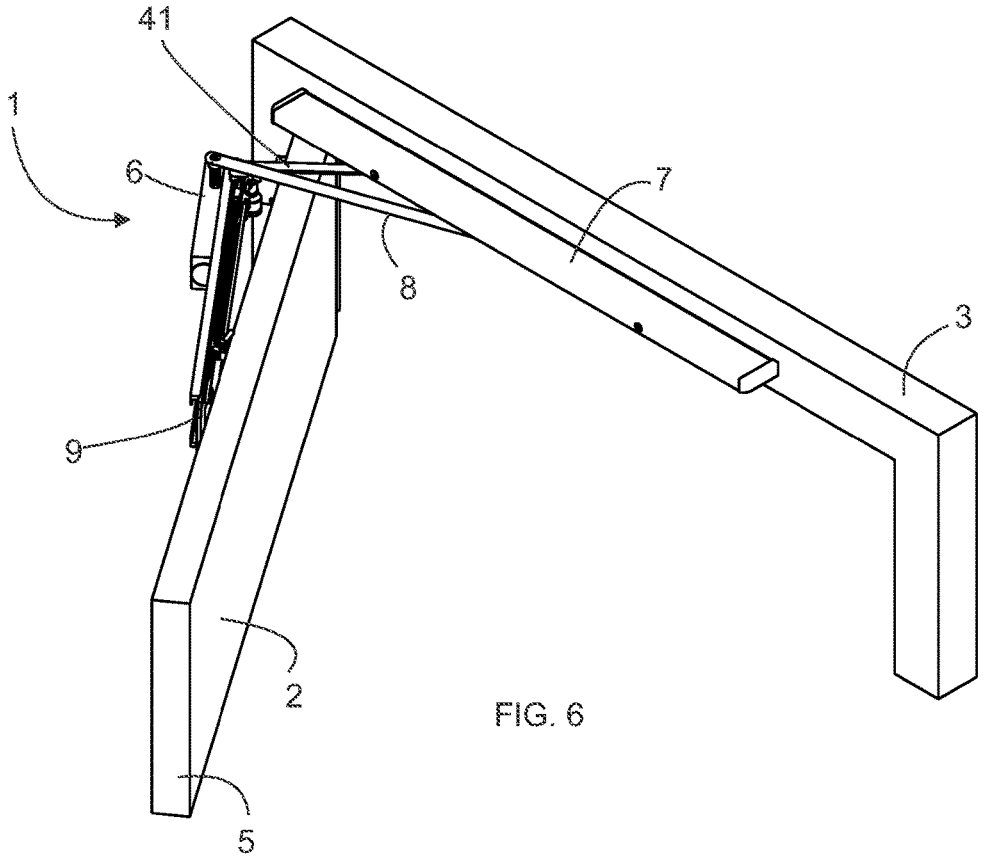
Figure 7:
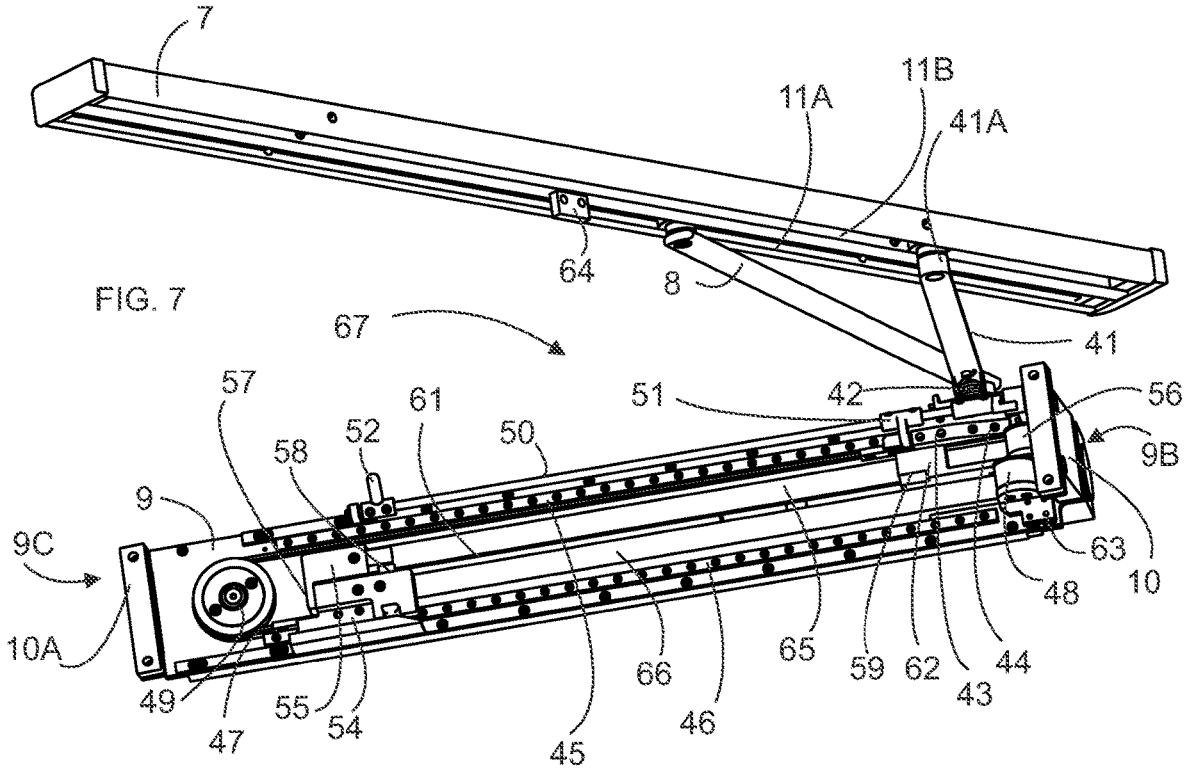
Figure 14:
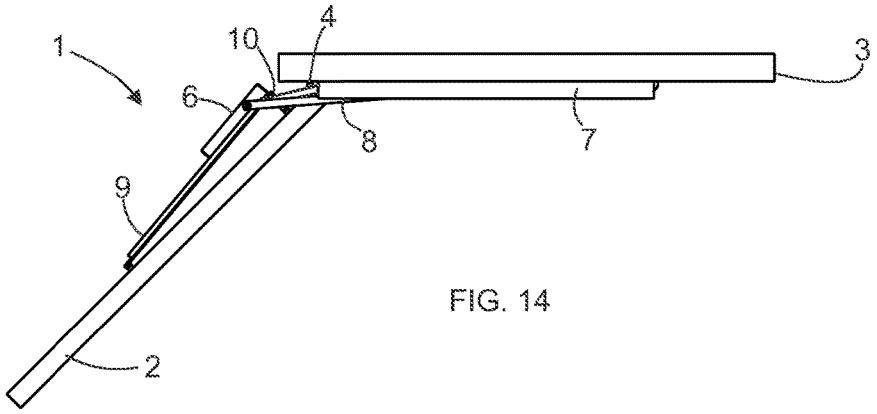

In FIG. 4 the door 2 is opened about 15-20 degrees. FIG. 5 shows the same situation. As can be seen the door closer 6 is at the hinge side 4A, i.e. at the first end 9B of the second rail 9. At the closed position of the door the door closer 6 is also at the first end 9B of the second rail, i.e. near the hinge side 4A of the door. The second rail makes it possible to situate the door closer more near the hinge side than in known solutions. So, the opening of the door is easier, which can be tedious in known solutions. When the door is opened, the door closer remains at the first end 9B of the second rail 9. FIG. 14 shows the door fully opened.

Figure 8:
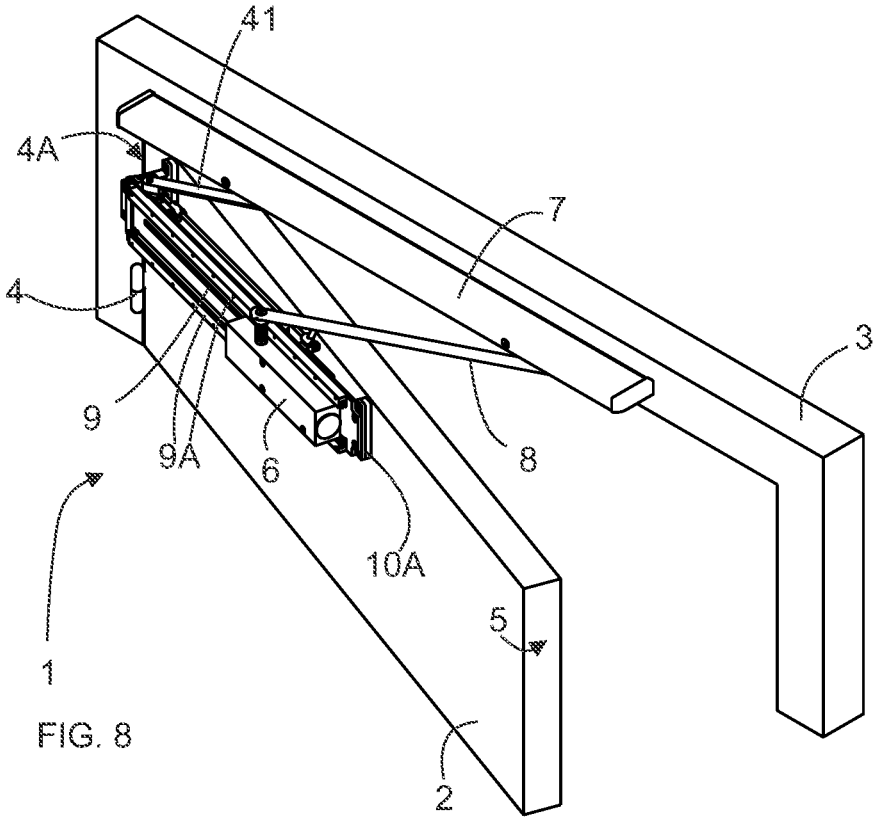
Figure 9:
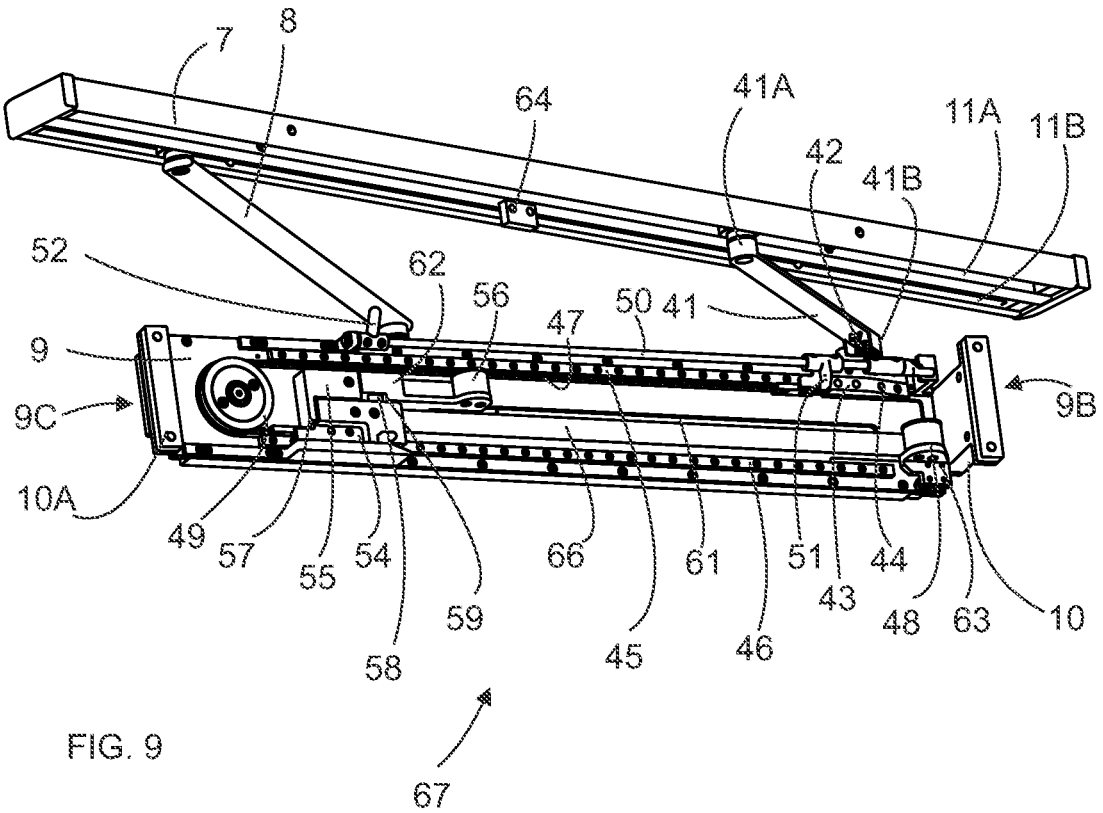

When closing the door from the fully opened position to an opening angle of about 20-30 degrees, the door closer remains at the first end 9B of the second rail 9. (The zero angle means that the door is closed.) Depending on an embodiment the door closer 9 and the carriage 17 starts to move towards the second end 9C of the second rail 9, in other words towards the lock side 5 at the opening angle of about 20-30 degrees. FIGS. 8 and 9 illustrate this situation where the door closer has moved to the second end 9C of the second rail.

The movement towards the lock side 5, is achieved by aid of the auxiliary motion arrangement utilizing the raising part. As said the raising part 10 at the first end 9B of the second rail forms the slide slope on the second rail for the door closer. The slide slope can actually be enough to move the door closer towards the lock side 5 of the door, so in which case the auxiliary spring arrangement is used only for moving the door closer back to the hinge side 4A, which is explained more later. As can be noticed the slide slope is a slope in relation to the surface 2A of the door.

When the door closer 6 is at the second end 9C of the second rail 9, i.e. near the lock side 5 of the door, or when moving towards the lock side, the closing power is bigger than keeping the door closer relatively near the hinge side 4A of the door. Therefore, the door closing action is improved in relation to know solutions.

The auxiliary spring arrangement further comprises an harvesting spring 48 attached on the second rail 9 and a transmission mechanism 47 between the harvesting spring 48 and the carrier 43 in order to tension the harvesting spring 48 when the carrier 43 and the harvesting arm 41 move towards the first end 9B of the second rail. The harvesting spring is conveniently attached to the second rail by using an attachment body 63. The opening angle area of the door wherein energy is harvested depends on an embodiment. The door weight, the power of the door closer 6, the slide slope performed by the raising part 10 and the second rail, the power of the harvesting spring and other parameters may vary. So, an energy harvesting range can be from a few degrees of the opening angle to the full opening angle of the door. An extreme embodiment may have the energy harvesting range starting from zero degree, but then user experience is not so good. In the figures the energy harvesting range is about 15-55 degrees. However, other ranges can be implemented as well, like about 10-30 degrees.

FIGS. 4 and 5 show a situation wherein the energy harvesting begins. As said the door opening angle is about 15-20 degrees. In this embodiment the energy harvesting continues until the door opening angle is about 50-60 degree, let's say for example about 55 degrees, as illustrated is FIGS. 6 and 7. The door opening may continue until the full opening angle illustrated in FIG. 14. It is worth to note that in another embodiment of the invention the opening range when the energy harvesting begins can be another like 20-30 degrees.

After the opening of the door and when the door is not kept open, the door closer 6 closes the door. The door closer is at the first end 9B of the second rail 9 at the beginning of the closing the door until the door has turned enough, let's say for example to an door opening angle a little more than 30 degrees, when the door closer starts to move along the second rail towards the lock side 5 of the door, i.e. towards the second end 9C of the second rail 9. The movement towards the lock side is achieved by the slide slope. FIGS. 8 and 9 show the situation when the door closer has moved to the second end 9C of the second rail. In this position the closing of the door is more efficient than if the door closer is near the hinge side 4A.

Figure 10:
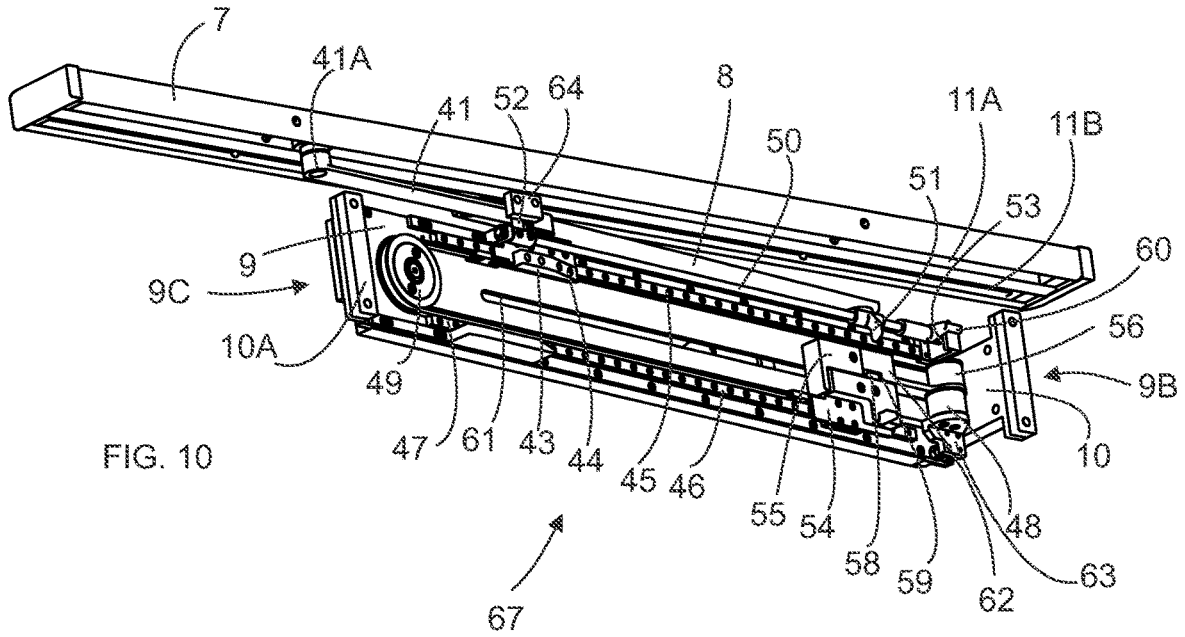

The energy of the harvesting spring 48 is released when the carrier 43 and the harvesting arm 41 move away from the first end 9B of the second rail. The auxiliary spring arrangement also comprises a switch mechanism 50, 51, 52 in order to keep the carrier 43 at a first end 9B of the second rail and to release the keeping of the carrier 43 when the door 2 has moved to a closed position. FIG. 10 shows this situation.

The switch mechanism embodiment of the examples of the figures comprises a retainer pin 51 to keep the carrier 43 at a first end 9B of the second rail and a release pin 52 to release the keeping of the carrier when the door 2 has moved to a closed position. The switch mechanism further comprises an axis 50 being provided with the retainer pin 51, the release pin 52 and a bias spring 53. The bias spring is arranged to turn the axis 50 in order to keep the retainer pin 51 at a retaining position. In other words, the bias spring turns the retainer pin towards the third rail 45 where the carrier 43 moves.

When the door is closed, at the end of the closing action, the release pin hits to the frame 3 of the door 2 or a specific plate 64 attached to the frame. The frame or the plate turns the release pin 52 which causes the turning of the axis 50 and the retainer pin 51. So, the retainer pin turns away from the retaining position where it keeps the carrier 43 in place. When the retainer pin has turned away from the retaining position the harvesting spring 48 pulls the carrier through the transmission mechanism 47 to move towards the second end 9C of the second rail 9. FIG. 10 shows the situation wherein the carrier 43 has moved to the vicinity of the second end 9C of the second rail and the tension of the harvesting spring has released.

As can be seen from the figures the carrier 43 has a guiding surface 44 for the retaining pin 51 for allowing the movement of the carrier towards the first end 9B of the second rail. The guiding surface is a slope in this embodiment. Further, the transmission mechanism comprises a belt, a band, a strip, a chain or a string 47 in the embodiments illustrated in the figures. The transmission mechanism may also comprise an idler 49 in order to direct the belt, a band, a strip, a chain or a string 47 to another direction as showed in the figures. So, the transmission mechanism can have a relatively long linear functioning distance located in a relatively short space. The transmission mechanism also comprises a connection part 54 between the harvesting spring 48 and the belt, band, strip, chain or the string 47. The connection part can make the attachment between the belt etc. and the harvesting spring to be more reliable or easier. The door closer arrangement may also comprise a fourth rail 46 on the second rail 9 forming a slide guide for the connection part 54.

The door closer arrangement comprises also an attachment part 62 attached on the carriage 17 on the second rail 9 and the connection part 54 has a protruding part 58. The connection part is arranged to move the carriage 17 and therefore also the door closer 6 through the protruding part 58 towards the first end 9B of the second rail 9 after the release of the keeping of the carrier 43. In other words, the harvested energy, which has been stored in the harvesting spring 48 is used to move the door closer back to the first end 9B of the second rail.

In addition, the auxiliary spring arrangement can further comprise a second harvesting spring 56 attached on the carriage 17 through an attachment part 62. Since it is convenient to situate the harvesting spring and the second harvesting spring to the other side of the second rail 9, the attachment to the carriage is made via a longitudinal slot 61 as illustrated in the figures. The attachment may utilize screws or bolts. The attachment part 62 performs a support for the second harvesting spring. As can be seen in the figures the third and fourth rails 45, 46 are situated on the other side of the second rail.

The harvesting spring and the second harvesting spring have metal strips 66, 65 in the embodiments of the figures, although the springs can be any suitable spring types.

The end of the metal strip 66 of the second harvesting spring is connected to a second connection part 55, which is arranged to move with the connection part 54 when tensioning the harvesting spring 48 So, the second harvesting spring is arranged to be tensioned at the same time, and to aid movement of the carriage 17 from the first end of the second rail 9. As can be noted the connection parts provide other useful features as well. As said, the second harvesting spring 56 can be tensioned at the same time when the harvesting spring 48 is tensioned. The tension of the second harvesting spring may also be used to aid partly the movement of the carrier 43 towards the second end 9C of the second rail.

The second connection part 55 can comprise a projection 57 towards the connection part 54. The projection makes it possible to tension the second harvesting spring at the same time when tensioning the harvesting spring 48. When the connection part 54 moves, the second connection part 55 moves also due to the projection 57.

The connection part can have a protruding 58 that is arranged to be against the attachment part 62 when the connection part 54 and the second connection part 55, are at the first end 9B of the second rail 9. The protruding 58 is also arranged to be against the attachment part 62 when the second connection part 55 is at the vicinity of the second end 9C of the second rail and the second harvesting spring 56 have been released from tension, i.e. the door closer is at the second end 9C of the second rail as well. Further, the protruding 58 is also arranged to be against the attachment part 62 when the tension of the harvesting spring 48 is releasing.

So, at the first case when the both connection parts 54, 55 are at the first end 9B of the second rail kept by the harvesting spring 48 is the situation where the door is closed. The second case is when the second connection part 55 is at the vicinity of a second end 9C of the second rail because the harvesting spring 48 has been tensioned, and the second harvesting spring 56 have been released from tension, so the second harvesting spring has aided the door closer 6 to move to the second end 9C of the second rail 9. The third case occurs when the door closer is moved back to the first end 9B of the second rail by the harvesting spring 48 after the door has been closed.

Figure 19:
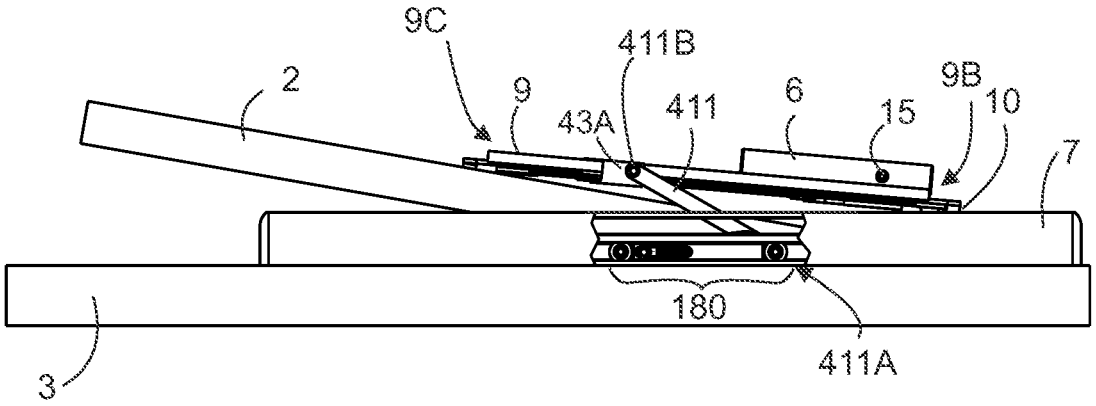
FIG. 19 illustrates another embodiment of an harvesting arm.

The door closer arrangement may also comprise a second bias spring 42 at the first end 41B of the harvesting arm 41 in order to keep the harvesting arm in suitable positions. The figures show positions where the second end 41A of the harvesting arm more near the lock side 5 than the first end 41B, but the positions can be designed to second end 41A be others. The first end 41B of the harvesting arm can be more near the lock side 5 than the second end 41A. This kind of embodiment is illustrated in FIG. 19. The first end 411B of the harvesting arm 411 is attached on the carrier 43A, which carrier can also be designed in many ways, as FIG. 19 indicates. The second end 411A is on the slide rail 7. In this embodiment the second bias spring 42 is not at the first end 411B, but as an alternative it 183 is located in a second bias spring arrangement 180, in the slide rail 7. See FIG. 20. The arm 8 is not illustrated in FIGS. 19 and 20 in order to show the second bias spring arrangement more clearly. FIG. 19 shows a situation where the door is opened about 5-15 degrees.

Figure 20:
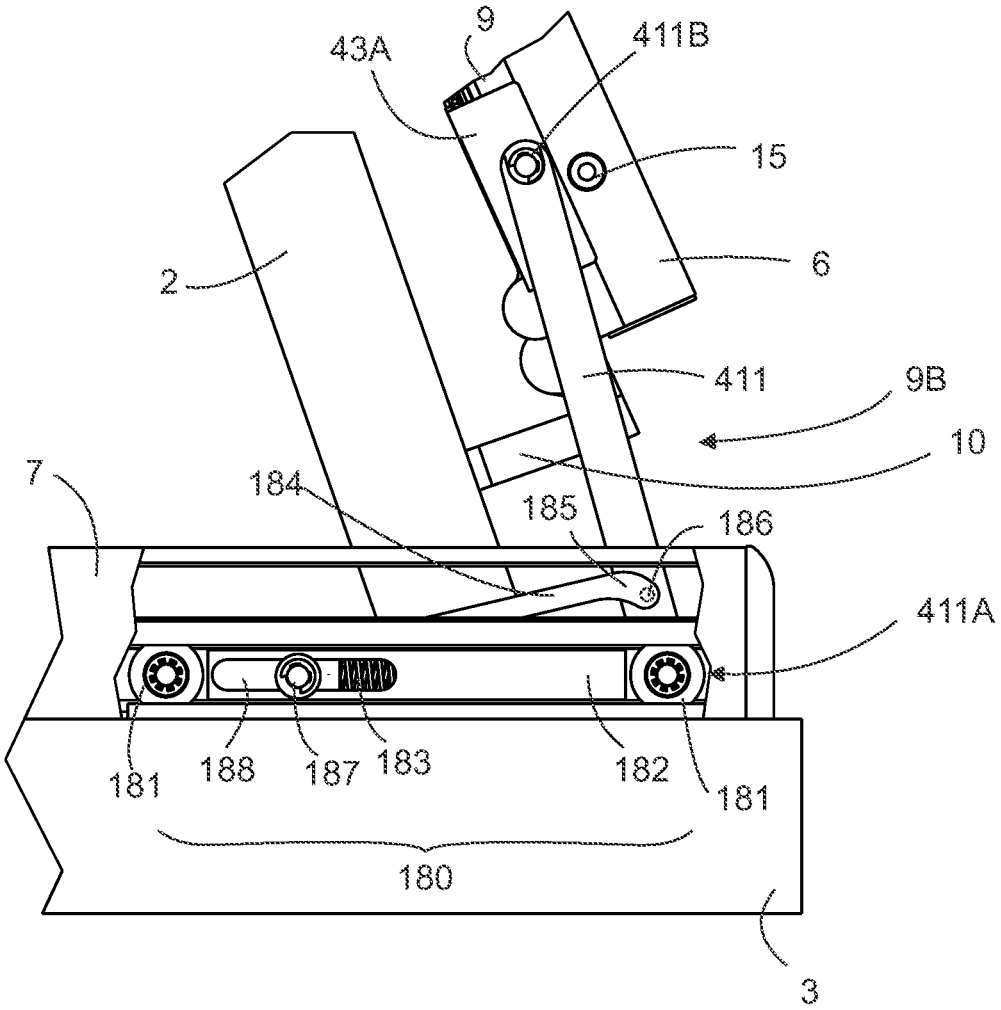
FIG. 20 illustrates a partial view of FIG. 19.

FIG. 20 shows a situation where the door is opened about 70-85 degrees. As said, the second bias spring arrangement has the second bias spring 183. The arrangement comprises also a body 182 providing an installation support/frame for other parts. The second bias spring arrangement further comprise two roller bearings 181, which can be formed as the second low-friction arrangement 16, which is described in more detail later, although other embodiments are also possible. So the second bias spring arrangement can slide in the slide rail via the roller bearings.

The second bias spring arrangement further comprises a lever 184, which is attached to the harvesting arm 411 on one end of the lever using a swivel axis 186 (and hole for the axis naturally). The harvesting arm 411 may also have a bend 185 near the swivel axis point. The other end of the lever 184 is attached on the body 182 through another swivel axis 187. The other swivel axis is situated at a longitudinal groove 188 on the body. The groove provides space for tensioning the second bias spring 183. The second bias spring tensions when the door is opened so the tension is the strongest when the door is fully opened.

As said, the second bias spring 42, 183 is used to keep the harvesting arm in suitable positions, or more precisely to aid to keep suitable positions. The functioning of the harvesting arm is also more reliable and more controlled. As can be seen there are many ways to perform and to install the second bias spring.

Further, the auxiliary motion arrangement may also comprise a second raising part 10A at a second end 9C of the second rail. The height and thus also the angle of the slide slope can be designed by the height of the raising part 10 and/or the second raising part 10A. Therefore, the slide slope can be designed to be suitable for different door closers and different doors. The raising parts 10, 10A can be integral parts with the second rail 9 or separate parts to be fixed with the second rail. The slide slope aids the movement of the door closer 2 (and the carriage 17) along the second rail 9. The second rail 9 can comprise at least one slide guide 9A to form the sliding attachment to the carriage 17.

As said above, in order that the door closer can be moved back the first end 9B of the second rail 9 after the door is closed, the auxiliary spring arrangement is used. So, when the door is back at the closed position, the auxiliary spring arrangement moves the door closer back to the hinge side 4A.

Figure 11:
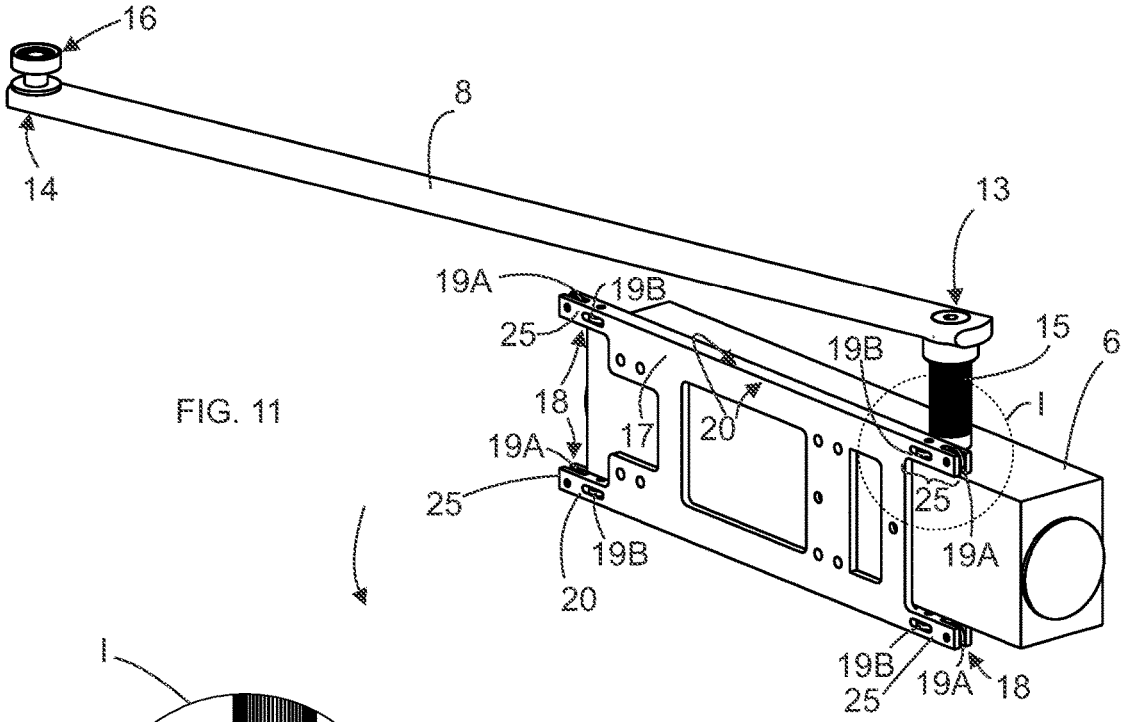

FIG. 11 illustrates the carriage 17, the door closer 6 attached to the carriage, and the arm 8. The door closer is attachable to the carriage, for example, using screws or bolts. The arm is attachable to the turning axis 15 of the door closer at the first end 13 of the arm. The arm is attachable to the slide rail 7 at the second end 14 of the arm.

Figure 12:
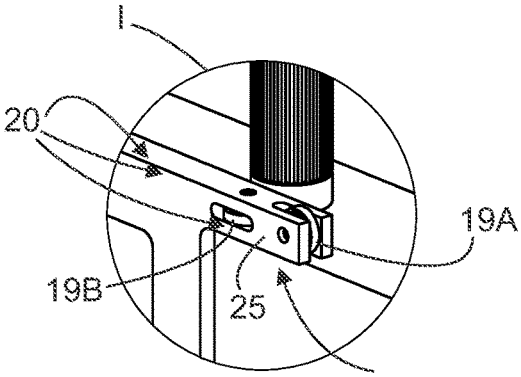
Figure 13:
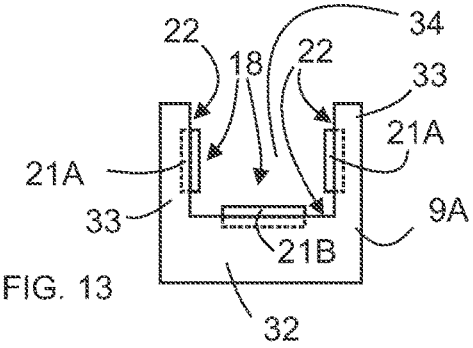
Figure 15:
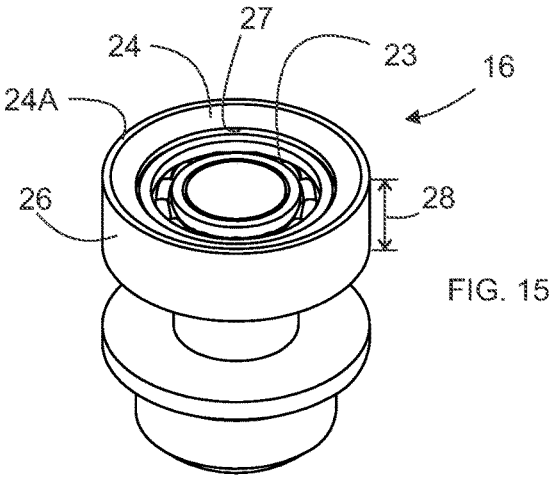

FIG. 11 shows also the first low-friction arrangement 18 and the second low-friction arrangement 16. In order that the door closer arrangement does not consume relative much power, it has the low-friction arrangements. In this way the operation of the door closer arrangement is smooth as well. The first low-friction arrangement 18 comprises a bearing arrangement 19A, 19B, 20, 21A, 21B, 22, and the second low-friction arrangement 16 comprises a second bearing arrangement 23, 24. See FIGS. 13 and 15. As can be seen, the second end 14 of the arm is connectable with the slide rail 7 through the second low-friction arrangement. FIG. 12 shows a partial view I from FIG. 11. Said low-friction arrangements are obtained by rolling bearings and/or plain bearings comprising friction reducing ingredients/material.

The bearing arrangement can be achieved in many ways. It can be a rolling bearing arrangement in the carriage 17. This arrangement comprising wheels 19A, which are arranged to contact the second rail 9 in a vertical direction, and wheels 19B, which are arranged to contact the second rail 9 in a horizontal direction. In this way the carriage contacts the slide guides via the wheels in the vertical and horizontal directions.

The carriage 17 can comprise four support members 25, which comprise the said wheels 19A, 19B, each support member having at least one wheel 19A in the vertical direction, and at least one wheel 19B in the horizontal direction.

The bearing arrangement can also be a rolling bearing arrangement in the slide guide 9A. See FIG. 13. This arrangement comprises rollers or balls 21A, which are arranged to contact the carriage 17 in a vertical direction, and rollers or balls 21B, which are arranged to contact the carriage 17 in a horizontal direction. As can seen in FIG. 13 the rollers or balls are attached in the bottom 32 part and the side parts 33 of the slide guide 9A, in such a way that the rollers or balls are towards the groove 34 of the slide guide. So, the bottom part 32 and two side parts 33 perform the groove 34 for the carriage 17.

The bearing arrangement can also be a plain bearing wherein the carriage 17 comprises sliding surfaces 20 and the slide guide/s 9A comprising second sliding surfaces 22, the sliding surfaces and/or the second sliding surfaces comprising friction reducing ingredients. The plain bearing can be achieved by using a suitable material/a material layer like Teflon. It is also possible to combine the plain bearing and the described rolling bearing arrangements.

Figure 16:
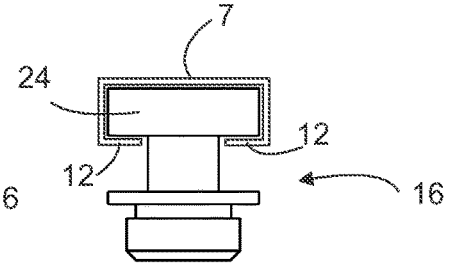
FIG. 16 illustrates a side view of FIG. 15.
Figure 18:
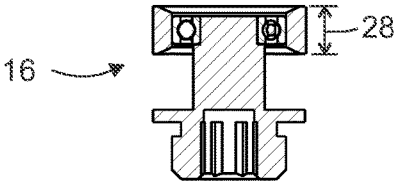
FIG. 18 illustrates, a cross-sectional view of the embodiment of FIG. 16.

The second bearing arrangement can comprise a ball bearing 23 or a roller bearing, which ball/roller bearing 23 comprises a ring 24 in order to provide a contact with the slide rail 7. See FIGS. 15, 16, and 18. The ring 24 has an outer surface 26 and the inner surface 27, and a width 28 of the ring in the perpendicular direction with respect to a radial of the ring is maximum at the outer surface 26. This arrangement makes it possible that the second bearing arrangement contacts with the slide rail 7 on the outer surface 26 and on the sides 24A of the ring near the outer surface. In this way the sides of the ring at shorter radial areas do not perform resistance when the wheel is rotating.

Figure 17:
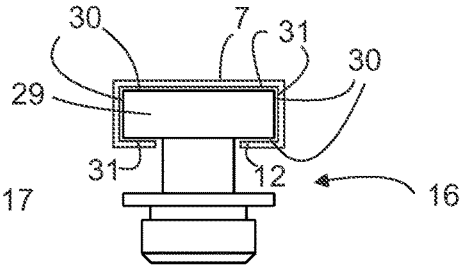
FIG. 17 illustrates another embodiment of the second bearing arrangement.

The second bearing arrangement can also be a plain bearing. This embodiment comprises third slide surfaces 30, 31 comprising friction reducing ingredients. The third slide surfaces are surfaces of a slide piece 29, which contact with the internal surfaces of the slide rail 7. See FIG. 17.

As disclosed above the invention can be obtained by using the harvesting spring 48 only. In this kind of embodiment there is more freedom to construct the inventive arrangement, since there is not the second harvesting spring 56. The harvesting spring can be obtained by different spring types. For example, a spiral torsion spring or a constant torque spring can be placed to the second end 9C of the second rail in which case any idler is not installed, and the transmission mechanism 47 is relatively short between the carrier 43 and the harvesting spring.

The other embodiment disclosed above is the arrangement with harvesting spring 48 and the second harvesting spring 56. In this embodiment the movement of the door closer from the second end 9C of the second rail to the first end 9B is made more reliable by the second harvesting spring.

As can be noticed above the invention can be made in many different ways. Further, it can mounted so that the second rail 9 is mountable on the door 2 or on a door frame 3, and the slide rail 7 is mountable on the door or the door frame. The invention performs an easy opening of the door and a safe closing of the door. When the door is closed the function of the tensioned spring of the door closer 6 is improved by the movement of the door closer along the second rail 9 towards the lock side 5 of the door 2 Using the raising part 10 at the first end 9B of the second rail the second rail has a certain angel in relation to the surface of the door or the door frame, and thus the second rail performs the slide slope. The slide slope can reduce power consumption when the door is closed.

It is evident from the above that the invention is not limited to the embodiments described in this text but can be implemented utilizing many other different embodiments within the scope of the independent claims.

The invention claimed is:

1. A door closer arrangement, comprising a door closer;

a slide rail;

an arm that connects the door closer with the slide rail;

a second rail;

a carriage configured to be attached to the second rail in a sliding manner, the carriage being arranged to form an attachment with the door closer;

a first low-friction arrangement between the second rail and the carriage;

a second low-friction arrangement between the arm and the slide rail; and an auxiliary motion arrangement configured to aid movement of the carriage and the door closer along the second rail, the auxiliary motion arrangement comprising:

a raising part at a first end of the second rail, forming a slide slope for the door closer, the first end configured to be installed adjacent a hinge side of a door; and an auxiliary spring arrangement attached at a first end to the slide rail and attached at a second end to the second rail.

2. The door closer arrangement according to claim 1, wherein the auxiliary spring arrangement comprises a harvesting arm, a carrier and a third rail, the third rail being on the second rail and the carrier being attached moveable on the third rail so that the carrier is capable to move along the third rail, the harvesting arm being turnable attached to the carrier at a first end of the harvesting arm, and being turnable and moveable attached to the slide rail at a second end of the harvesting arm, the auxiliary spring arrangement further comprising an harvesting spring attached on the second rail and a transmission mechanism between the harvesting spring and the carrier in order to tension the harvesting spring when the carrier and the harvesting arm move towards the first end of the second rail, and to release energy of the harvesting spring when the carrier and the harvesting arm move away from the first end of the second rail, the auxiliary spring arrangement also comprising a switch mechanism in order to keep the carrier at a first end of the second rail and to release the keeping of the carrier when the door has moved to a closed position, the door closer arrangement also comprising an attachment part attached on the carriage on the second rail, and the transmission mechanism comprising a connection part having a protruding part, which connection part is arranged to move the carriage through the protruding part towards the first end of the second rail after the release of the keeping of the carrier.

3. The door closer arrangement according to claim 2, wherein the transmission mechanism comprises a belt, a band, a strip, a chain or a string.

4. The door closer arrangement according to claim 3, wherein the transmission mechanism comprises an idler.

5. The door closer arrangement according to claim 4, wherein the connection part is between the harvesting spring and the belt, band, strip, chain or the string.

6. The door closer arrangement according to claim 5, wherein it comprises a fourth rail on the second rail forming a slide guide for the connection part.

7. The door closer arrangement according to claim 5, wherein the auxiliary spring arrangement further comprises a second harvesting spring attached on the carriage through the attachment part, an end of the second harvesting spring being connected to a second connection part, which is arranged to move with the connection part when tensioning the harvesting spring, and to be tensioned at the same time, and to aid movement of the carriage from the first end of the second rail.

8. The door closer arrangement according to claim 7, wherein the second connection part comprises a projection towards the connection part, and the protruding part is arranged to be against the attachment part when the connection part and the second connection part, are at the first end of the second rail, and when the second connection part is at the vicinity of a second end of the second rail and the second harvesting spring have been released from tension, and also then when the tension of the harvesting spring is releasing.

9. The door closer arrangement according to claim 2, wherein the switch mechanism comprises a retainer pin to keep the carrier at a first end of the second rail and a release pin to release the keeping of the carrier when the door has moved to a closed position, the switch mechanism further comprising an axis being provided with the retainer pin, the release pin and a bias spring, the bias spring being arranged to turn the axis in order to keep the retainer pin at a retaining position.

10. The door closer arrangement according to claim 9, wherein the carrier has a guiding surface for the retaining pin.

11. The door closer arrangement according to claim 9, wherein the first end of the harvesting arm comprises a second bias spring.

12. The door closer arrangement according to claim 1, wherein the second rail comprises at least one slide guide.

13. The door closer arrangement according to claim 12, wherein the first low-friction arrangement comprises a bearing arrangement, and the second low-friction arrangement comprises a second bearing arrangement.

14. The door closer arrangement according to claim 13, wherein the bearing arrangement is a rolling bearing arrangement in the carriage, the arrangement comprising wheels, which are arranged to contact the second rail in a vertical direction, and wheels, which are arranged to contact the second rail in an horizontal direction.

15. The door closer arrangement according to claim 14, wherein the carriage comprises four support members, which comprises the said wheels, each support member having at least one wheel in the vertical direction, and at least one wheel in the horizontal direction.

16. The door closer arrangement according to claim 13, wherein the bearing arrangement is a rolling bearing arrangement in the slide guide, the arrangement comprising rollers or balls, which are arranged to contact the carriage in a vertical direction, and rollers or balls, which are arranged to contact the carriage in an horizontal direction.

17. The door closer arrangement according to claim 13, wherein the bearing arrangement is a plain bearing wherein the carriage comprises sliding surfaces and the slide guide/s comprising second sliding surfaces, the sliding surfaces and/or the second sliding surfaces comprising friction reducing ingredients.

18. The door closer arrangement according to claim 17, wherein the second bearing arrangement comprises third sliding surfaces comprising friction reducing ingredients.

19. The door closer arrangement according to claim 13, wherein the second bearing arrangement comprises a ball bearing or a roller bearing, which ball/roller bearing comprises a ring in order to provide a contact with the slide rail, the ring having an outer surface and the inner surface, and a width of the ring in the perpendicular direction with respect to a radial of the ring being maximum at the outer surface.

20. The door closer arrangement according to claim 13, wherein the slide guide comprises a bottom part and two side parts, the bottom part and the side parts performing a groove for the carriage.

21. The door closer arrangement according any of claim 1, wherein the second rail comprises a second raising part at a second end of the second rail.

22. The door closer arrangement according to claim 1, wherein the second rail is mountable on the door or on a door frame, and the slide rail is mountable on the door or the door frame.

* * * * *